US005362088A

United States Patent [19]

Rohrmoser

[11] Patent Number: 5,362,088

[45] Date of Patent: Nov. 8, 1994

[54] SAFETY SKI BINDING HAVING TOE AND HEEL FORKED CLAMP ASSEMBLIES

[75] Inventor: Alois Rohrmoser, Wagrain, Austria

[73] Assignee: Varpat Patentverwertungs AG, Littau, Switzerland

[21] Appl. No.: 150,590

[22] Filed: Nov. 10, 1993

Related U.S. Application Data

[63] Continuation of Ser. No. 928,155, Aug. 10, 1992, abandoned, which is a continuation of Ser. No. 474,860, Dec. 10, 1990, abandoned.

[30] Foreign Application Priority Data

Feb. 21, 1989 [DE] Germany ..... 3905293

[51] Int. Cl.[5] ..... A63C 9/085; A63C 9/22

[52] U.S. Cl. ..... 280/625; 280/629; 280/630; 280/634

[58] Field of Search ..... 280/616, 625, 626, 627, 280/629, 630, 633, 634

[56] References Cited

U.S. PATENT DOCUMENTS

| | | | |
|---|---|---|---|
| 3,194,574 | 7/1965 | Beyl | 280/625 |
| 3,198,536 | 8/1965 | Rossellat | 280/629 |
| 3,873,113 | 3/1975 | Suhner | 280/625 |
| 4,078,828 | 3/1978 | Salomon | 280/625 |
| 4,155,569 | 5/1979 | Salomon | 280/625 |
| 4,219,217 | 8/1980 | Gertsch | 280/629 |
| 4,401,318 | 8/1983 | Beyl | 280/625 X |
| 4,478,426 | 10/1984 | Scheck | 280/625 |
| 4,979,762 | 12/1990 | Gallet | 280/634 X |

FOREIGN PATENT DOCUMENTS

| | | | |
|---|---|---|---|
| 241318 | 7/1965 | Austria | 280/629 |
| 0242575 | 9/1965 | Austria | 280/629 |
| 0261456 | 4/1968 | Austria | 280/616 |
| 377707 | 4/1985 | Austria . | |
| 1140179 | 1/1983 | Canada | 280/629 |
| 1809889 | 6/1970 | Germany | 280/629 |
| 2802251 | 7/1979 | Germany | 280/633 |
| 8223875 | 12/1982 | Germany . | |
| 3335878 | 4/1984 | Germany | 280/629 |
| 8804613 | 8/1988 | Germany . | |

*Primary Examiner*—Brian L. Johnson
*Attorney, Agent, or Firm*—Collard & Roe

[57] ABSTRACT

A ski binding for a longitudinally extending ski including a forked toe clamp including two fork prongs for holding a front part of the ski boot. The forked toe clamp is rotatable around an axis. The ski binding also includes a forked heel clamp for holding a rear part of a ski boot. A tension screw spring and a slot are provided. The forked heel clamp is guided in the longitudinal direction by the slot and is biased toward the toe clamp by the tension screw spring. A centering apparatus formed as two flexible spring devices and are located on the two clamps between the two fork prongs. The force of the spring devices is approximately equal to the force of the tension screw spring so that, when the forked toe clamp is rotated, the spring devices prevent the ski boot from moving in the longitudinal direction toward the axis.

10 Claims, 6 Drawing Sheets

FIG. 3
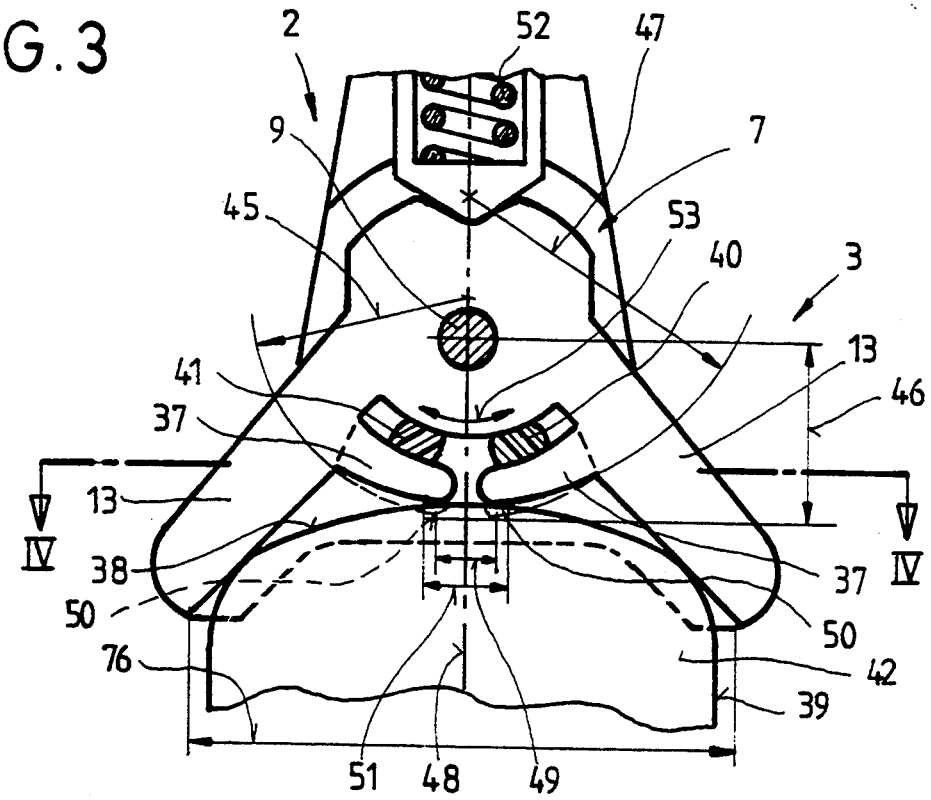
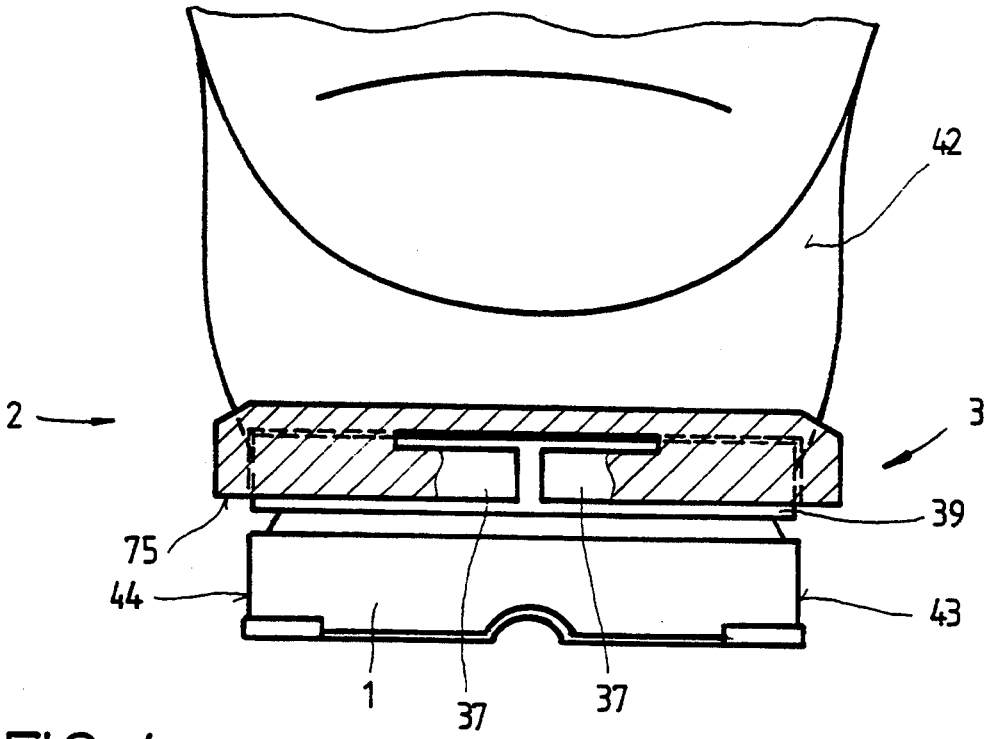
FIG. 4

SAFETY SKI BINDING HAVING TOE AND HEEL FORKED CLAMP ASSEMBLIES

CROSS REFERENCE TO RELATED APPLICATIONS

This is a continuation of application Ser. No. 07/928,155, filed Aug. 10, 1992 and now abandoned, which in turn is a continuation of application Ser. No. 474,860, filed Dec. 10, 1990, and now abandoned, which is based upon International Application PCT/AT89/00038, filed on Apr. 18, 1989, and designating the U.S.

BACKGROUND OF THE INVENTION

1. Field of the Invention

The invention relates to a safety ski binding having a forked front clamp which guides the front sole of the ski boot and a forked heel clamp which guides the ski boot in the area of the arch when the forked front clamp is angled.

2. Description of the Prior Art

A safety ski binding of this type is known from the German registered design 82 23 875. In this ski binding both the front clamp as well as the heel clamp are guided by sliding in guides fixed to the skis along the length of the skis. The front and heel clamps are coupled with a flexible connecting bar so that they can be slid as a unit along the ski in order to optimize the dynamic properties of the ski. The front clamp can be secured in a desired position while the heel clamp can be freely moved, in order to prevent an undesirable stiffening of the ski in the area of the binding.

The sole holder of the heel clamp which extends to the arch of the ski boot is moveable in relation to the binding bars fixed to the skis led over the front clamp and is harnessed on the front clamp by a tension spring. The spring serves to apply a constant tension so that the ski boot lies on the sole holder of the front clamp and will, therefore, for constant release conditions, swing out in all events at a given release tension point, with the sole holder of the front clamp freed from the ski boot.

In the tension release of the safety ski binding, in which the front clamp frees the ski boot, it is desirable that the ski boot rotate about an axis essentially corresponding to the shin axis in order to maintain predetermined angle radii of the front sole area as well as the back sole area. In particular, in the angle movement of the ski boot, the sole or arch holder of the heel clamp should move so that they follow the angle movement of the shin axis.

The sole holder of the front clamp is formed in the usual manner as a forked clamp and leads the ski boot into its normal placement on opposite sides in an approximate point formation. Because of the kinetics of the angle movement of the ski boot and the sole holder which slides in a axis in front of the ski boot, the front clamp achieves the conventional safety ski binding in the release tension of the sole holder of the clamp in forward movement of the ski boot in the longitudinal direction of the ski. In this manner, the ski boot is slid forward by the tension spring of the heel clamp during the release movement of the front clamp. The angle axis also shifts forward thereby, which impairs the evenness of the release movement.

SUMMARY OF THE INVENTION

The object of the invention is to provide a safety ski binding which makes possible a sure release of the front clamp, while preventing an undesired release in the event of brief impacts.

This objective is achieved by the invention by a binding with front clamps and/or the heel clamps constructed as centering devices. These centering devices can spring adjust essentially parallel to a central longitudinal axis comprised of the front and heel clamps. These centering devices are located on both sides of the central longitudinal axis. The spring or centering device of the front clamp and the heel clamp, thus work against each other and hold the ski boot during the tension movement causing release of the front clamp. The springs hold the ski boot in an even weigh in relation to the ski, so that the swing axis of the ski boot and therefore the shin axis do not deviate from the longitudinal ski direction. The spring strength of both spring devices are necessarily of the same measure so that not even in various friction circumstances can differences occur in the spring strengths. The spring strength of the front spring device is therefore necessarily somewhat less than the spring strength of the spring device of the heel clamp.

A ski binding is provided for a longitudinally extending ski including a forked toe clamp including two fork prongs for holding a front part of the ski boot. The binding also has a forked heel clamp for holding a rear part of a ski boot. The toe clamp is rotatable around an axis. A tension screw spring and a slot are provided. Centering means are provided which are formed as two deformable spring devices located on the toe clamp between the fork prongs. The force of the spring devices is approximately equal to the force of the tension screw spring. When the forked toe clamp is rotated, the spring device prevents the ski boot from moving in the longitudinal direction toward the axis. The forked toe clamp and said spring device are made of a resilient material and are formed as an integral unit.

The spring devices form spring flaps at least in the area of its free end at the ski boot. The spring flaps face each other across the longitudinal axis. The toe clamp rotates about an axis and a surface of the spring devices on the heel clamp facing the ski boot is approximately shaped as an arc with the center point being the axis of the toe clamp. The spring devices are bent in a circle having a radius centered on the longitudinal axis which is larger than a distance between the axis of said toe clamp and the heel clamp applied to the front side of said spring device.

The spring strength of the spring devices of the toe clamp may be less than the spring strength of the tension screw spring. At least one of the centering means and the spring flaps are supported by spring devices made of interchangeable rubber inserts and plastic inserts. The spring devices are formed of a screw spring or bow springs. The centering means are supported generally in parallel of the longitudinal axis and are inserted between the spring devices. The spring devices may be made of, for example, rubber and/or plastic, or a screw spring in the toe or heel clamps and may be adjustable.

The centering means includes swing arms which run vertical to an assembly surface of the toe and heel clamps on a spring axis. The spring axis swings between the spring devices in the direction of the toe or heel clamps under spring tension. The spring devices may be adjustable. The distance parallel to an assembly surface of the toe and heel clamps between the centering means or from contact points of the spring devices is less than half the width of the sole holder.

The distance running parallel to an assembly surface of the toe and heel clamps is generally in the range of 5 mm to 20 mm. The preferred distance is 10 mm. The spring strength of the centering means or the spring devices on the toe clamp is less than the spring strength of the spring device in the heel clamp. The axis can be moved, and the spring device and centering means and a mid point on the longitudinal axis lies straight with the frontal side of the toe clamp applied to the heel clamp. Either the front end of the fork prong extending to the heel clamp or to the toe clamp vertically to the side of one of the heel clamps or the toe clamp vertically through contact points between the centering means and spring devices with the ski boot in the area of the longitudinal axis.

Conventional sole holders, as well as the front clamps and heel clamps, are formed as multiple forked clamps. The forks take the front sole area or the arch area of the ski boot between the prongs and hold it to the ski by depression shoulders. In a preferred configuration, the spring device is applied in at least one of the two sole holders between the two prongs of the forked clamp and extends directly to the ski boot. Such construction can be realized with relatively low cost, especially if the spring device is an integral part of the resilient material of which the forked clamp is produced, such as plastic. Preferably, the spring device is formed so that at least one of the spring flaps in the area of its free end extends to the ski boot, for the sake of symmetry however it is necessary that two of the prongs oriented essentially across the longitudinal direction of the ski are set on top of one another at the arranged spring flaps.

The further advantage is that, when the centering devices of a forked clamp holding the ski boot are arranged between the prongs which form at least one sole holder, centering of the ski boot between the fork prongs can immediately occur when placed in the binding.

Furthermore, it is also possible that the forked clamp and the spring device be made of resilient material, especially plastic, to form an integrated unit, so that the spring device can be produced simply and directly with the forked clamp without additional assembly procedures.

Still another advantage is that, when the spring device is formed with at least one spring flap extending to the ski boot in the area of its free end, then, through the elasticity of the selected plastic or the corresponding wall thickness in the bend area, adjustment is possible to the various loads or resistance strengths.

In another production variant, it is proposed that two spring flaps oriented toward each other protrude from the forked clamps essentially across the longitudinal axis. This production form has the advantage that, through a normally stronger form, a larger support surface is achieved through the end area of the spring flaps than a point loading, which, above all, in the highly frequent impacts which is the circumstance at high speed over uneven trails, works to damp unguided movement so that undesired erroneous releases can be immediately modified.

The spring device which is applied to the front clamp, extending directly to the sole of the ski boot, in order that it not hinder the swing motion of the sole holder, is necessarily bent around the swing axis of the sole holder, particularly approximating a circular arc. This permits the spring flaps mentioned above to be produced especially simply, if the spring flaps are bent in a circular arc.

According to another production variant, it is proposed that the spring devices be bent in the form of a circular arc, and that a radius of the circle enclosure be larger than the distance between the swing axis of the forked clamp and the front side of the centering or spring device applied to the heel clamp, the middle point of which is arranged on the longitudinal axis. By the corresponding selection of a radius which is larger than the distance between the spring flaps and the swing axis in the direction of a central longitudinal axis, the safety ski binding will achieve swing of both radii over a greater swing area, particularly a forward side of the sole of the ski boot and the spring flaps, whereby undesired longitudinal dislocations of the ski boot in relation to the ski will be simply prevented.

It is also possible, however, that the sole holders as well as the front clamp and the heel clamp be formed as forked clamps, with the spring device applied to the front clamp extending directly to the ski boot arranged between the clamp prongs, and that the forked clamp of the heel clamp be guided in the longitudinal direction of the ski on a bar fixed to the ski tightened forward by a screw tension spring at the front clamp, by which, at the rest position of the front and heel clamps, the stable behavior of the ski boot is achieved.

According to another production variant, it is proposed that the spring strengths of the spring devices of the front clamp and the heel clamp have the same setting so that they are approximately even, so that undesirable erroneous releases can be more simply modified in steering motion of the ski boot.

It is also advantageous, however, if the spring strength of the spring device of the front clamp is greater than the spring strength of the spring device of the heel clamp, so that the higher friction strengths between the front clamp and the ski boot or the greater sole position surfaces in relation to swing axis 33 can equalize and nevertheless provide somewhat equal tension strengths in the area of the front clamp and the heel clamp.

Furthermore, it is also possible to support the centering devices or spring flaps with spring devices, especially replaceable rubber and/or other plastic insertions, in the front or heel clamps, whereby the spring strengths and therefor the damping action can be simply adjusted for various application needs.

Another production variant is advantageous, whereby the spring device is comprised of a screw or elbow spring, so that thereby for each individual user the spring area can be adjusted to the skiing ability by setting the damping action.

On the other hand, it is also possible to support the centering devices in guides running somewhat parallel to the central longitudinal axis by insertion of a spring device. The spring device can be made of, for example, rubber and/or plastic or a screw spring or the like, in the front and/or heel clamps. The spring device may also be equipped with a setting device, so that, in the event of disengagement of the front clamp, a predefined reinforcement of the sole of the ski boot can be achieved at the front clamp through the centering device or the fork of the front clamp. Nevertheless, fine adjustment for all setting possibilities can be achieved.

It is also possible, however, that the centering devices be formed as swing arms, which are mounted to pivot around a swing axis running vertical to an assembly surface of the front or heel clamps and are held under spring tension in the direction of the heel and/or front clamp using a spring device, so that the release movements are more strongly supported when the predetermined tension allowances are exceeded since the damping action inherent in the system is eliminated.

A further advantage is when a spring characteristic of the spring device can be set by adjustment so that a still better adjustment of the entire system for various application circumstances is possible.

It is furthermore possible, however, that a position running parallel to an assembly surface of the front and/or heel clamps between the centering devices or from the rest positions of the spring devices be less than half the width of the sole holder, so that the distance been the centering devices or the support points can be loosely predefined in addition to the area in which a damping of the disengagement motion or release takes place.

According to another production form, it is proposed that a position running parallel to the assembly surface of the front and/or heel clamps amount to about between 5 mm and 20 mm, preferably 10 mm, so that a release of the ski binding in a shift between 5 degrees and 10 degrees can be attained in all events independent of the spring strength set by means of freeing or falling out of the side guide of the ski boot in the area of the front clamp.

It is also advantageous, however, when the spring strength of one of the spring devices applied to the two centering devices or spring devices is less than the spring strength of the spring device in the heel clamp, so that the spring strength with which the individual spring elements are loaded can be varied and, for example, the spring device positioned nearer the inside edge can have greater tension nearer the outer edge of the ski so that, when the ski is on edge, the respective damping will be appropriately greater in the opposite direction, for example, in the movement of the skis as in the springing at a slalom pole, or the like. In all events, however, it will be ensured that the spring strength caused by the friction loss and the spring strength in the area of the front clamp will not be greater than the spring strength of the spring device in the heel clamp.

Finally, the sole holder of the front or heel clamp has a swing axis. The forward surface of a spring device or centering device extends to the ski boot and a mid point of the central longitudinal axis. The forward surface of the sole holder of the heel clamp extends to the front clamp and places the forward end of the fork extending either to the heel clamp or front clamp on a side away from the heel or front clamps. The forward end of the fork is also in a straight line vertically through the rest point between the centering devices or spring devices and the ski boot in the area of the central longitudinal axis. In this manner, any movement beyond the dead point position results in an immediate release of the ski binding or a side freeing of the ski boot in ejection from the safety ski binding.

BRIEF DESCRIPTION OF THE DRAWINGS

In the following, the present drawings for production examples of the invention are further explained.

FIG. 3 is an overview of a front clamp;

FIG. 4 shows the front clamp from a frontal view, in cross-section along lines IV—IV in FIG. 3.

DETAILED DESCRIPTION OF THE PREFERRED EMBODIMENT

Figure 1:
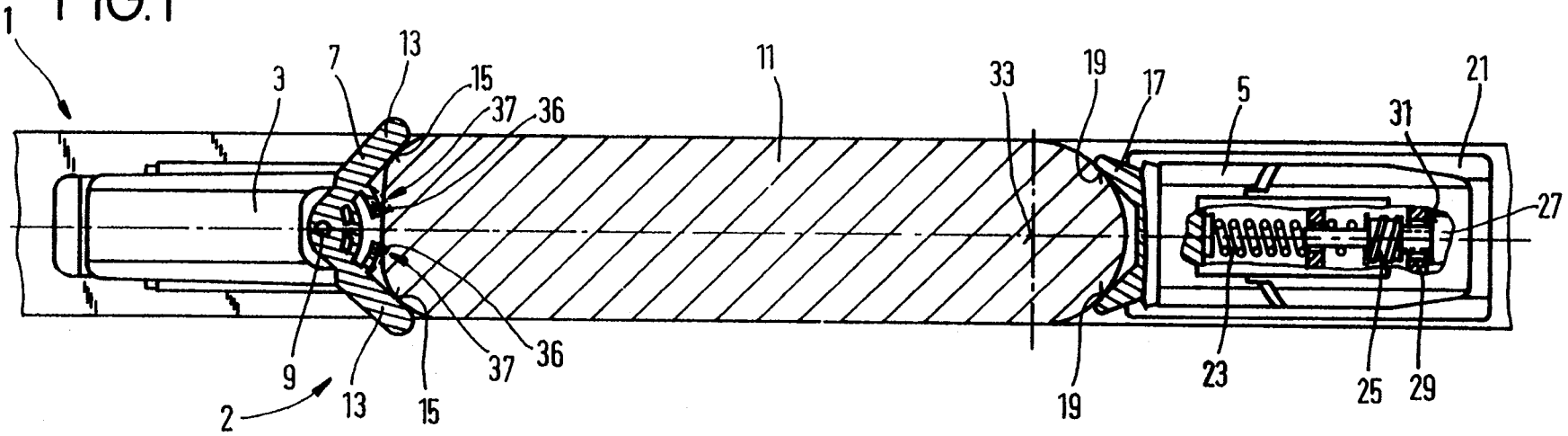
FIG. 1 is a partial overview of the safety ski binding in the normal position.

FIG. 1 shows safety ski binding 2 mounted on ski 1 with front clamp 3 and heel clamp 5. Front clamp 3 is mounted or set fixed to the ski and has a sole holder formed by forked clamp 7, which swings on swing axis 9 vertically to the plane of ski 1. In the normal position, forked clamp 7 holds the front end of the sole of ski boot 11 on opposite sides of the longitudinal center of the ski between its fork prongs 13 at critical point or line positions 15. The forked clamp is set in its normal position, and will swing out ,Dr the normal position, thereby freeing ski boot 11, upon tensions experienced by ski boot 11 in excess of that determined.

Heel clamp 5 holds ski boot 11 in the area of the heel ahead with forked clamp 17, also at two points or line positions 19 on either side of the longitudinal center of the ski. Forked clamp 17 swings in parallel with the axis running across the plane of the ski, not clearly shown, and is also set in the normal position. It will be released with the front support in the mentioned manner, thereby freeing the heel of ski boot 11.

In proper binding position, ski boot 11 will be held by a determined spring strength between forked clamp 7 and forked clamp 17. In order for the adjustment of the tension strength, heel clamp 5 slides guided in slot 21 in the longitudinal direction of the ski. Heel clamp 5 is supported by spring device 23 on endless screw 25, which, in an axis running in the longitudinal direction of the ski, winds linearly into a part fixed to the ski, not clearly shown. Screw 25 is attached to setting bolt 27, over which it turns, sliding the length of the linearly wound part fixed to the ski. By shifting the position of screw 25, the position and therefore the distance of forked clamp 17 in relation to front clamp 3 are adjusted. Furthermore, with the insertion of ski boot 11, the tension caused by screw tension spring 22, which forms spring device 23, changes. Attachment 29 limits the forward reach of heel clamp 5 in the absence of ski boot 11. Attachment 29 which is contained in heel clamp 5 therefore introduces forward surface 31 for screw 25.

In the tension release of front clamp 3, ski boot 11 swings along axis 33, purposefully corresponding to the shin axis. The heel area of ski boot 11 has the form of a circular arc around swing axis 33, such that forked clamp 17 enables ski boot 11 to move in swing axis 33, which remains constant with the ski. The front end of the ski boot sole runs approximately in a circle with swing axis 33. This leads to the situation represented in FIG. 2 when front clamp 3 is released. Due to the kinetics of the opposite, matching swing motions of the front end of the ski boot sole and the essentially V-shaped forked clamp 7, for swing axis 9 or 33 distanced from the contact points in opposite directions, gap 35 forms between the front end of the ski boot sole and fork prong 13 which lies turned back. Screw tension spring 22 therefore tends to push ski boot 11 forward so that again it will rest on both fork prongs 13. In order to work against this forward movement of ski boot 11 in the direction of swing axis 9, on forked clamp 7, extending directly to the front sole area of ski boot 11, spring device 37 is provided, comprised of two spring flaps 36. Spring flaps 36 extend out from fork prongs 13 toward each other, positioned with their free ends ahead of the sole of ski boot 11. They are formed as circular arcs around swing axis 9, and ski boot 11 held in the ski binding presses upon them. The spring strength of spring flaps 36 is essentially the same as the tension strength of screw tension spring 22, but, due to the boot or other reasons, the tension strength working against the tension strength of screw tension spring 22 can be less than tension strength 24 of screw tension spring 22.

Figure 2:
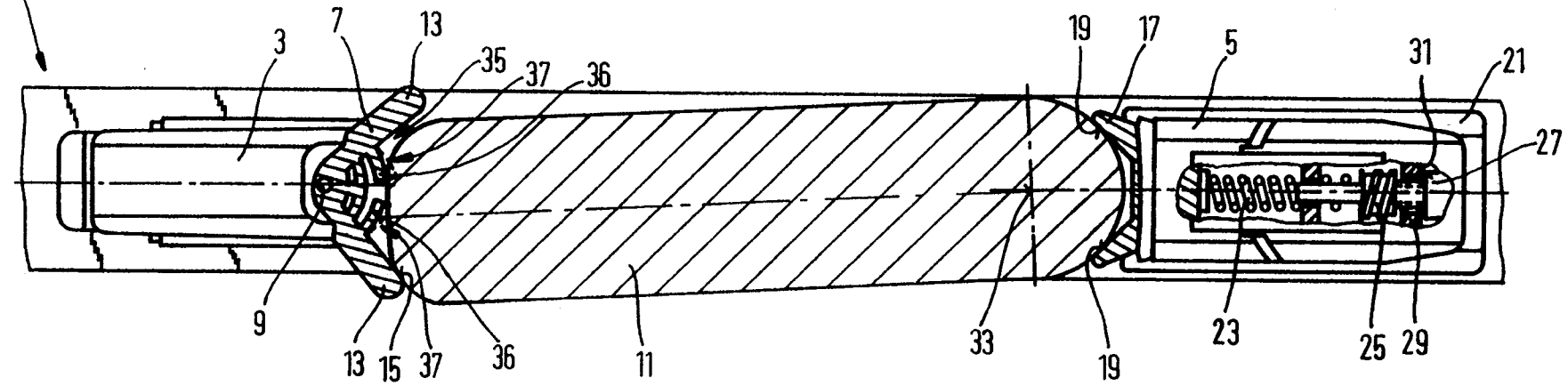
FIG. 2 is a partial overview of the ski binding with a released front clamp.

FIG. 1 shows by an interrupted line the inward springing of spring flaps 36 in the normal position of the binding. In FIG. 2 spring flaps 36 are sprung outward, and the inward sprung position is shown by an interrupted line. Comparison of FIG. 1 and FIG. 2 shows that spring flaps 36 and the one fork prong 13 positioned forward in the direction of movement hold the effect of screw tension spring 22 on ski boot 11 in equilibrium with the swing motion, so that the position of swing axis 33 does not change relative to ski 1.

Spring flaps 36 are an integral part of forked clamp 7, suitably comprised of plastic forms.

Front clamp 3 and heel clamp 5 can be separately fixed to the ski; nevertheless, in accordance with registered design 82 23 875, they can also be coupled in a flexible binding slat, moveable as a unit along the length of the ski.

It is understood that forked clamp 17 of heel clamp 5 can be provided with integral spring flaps similar to those of forked clamp 7 instead of screw tension spring 22. Also, front clamp 3 can be slid in a guide fixed to the ski, held in tension by a tension spring together on the ski boot.

Figure 9:
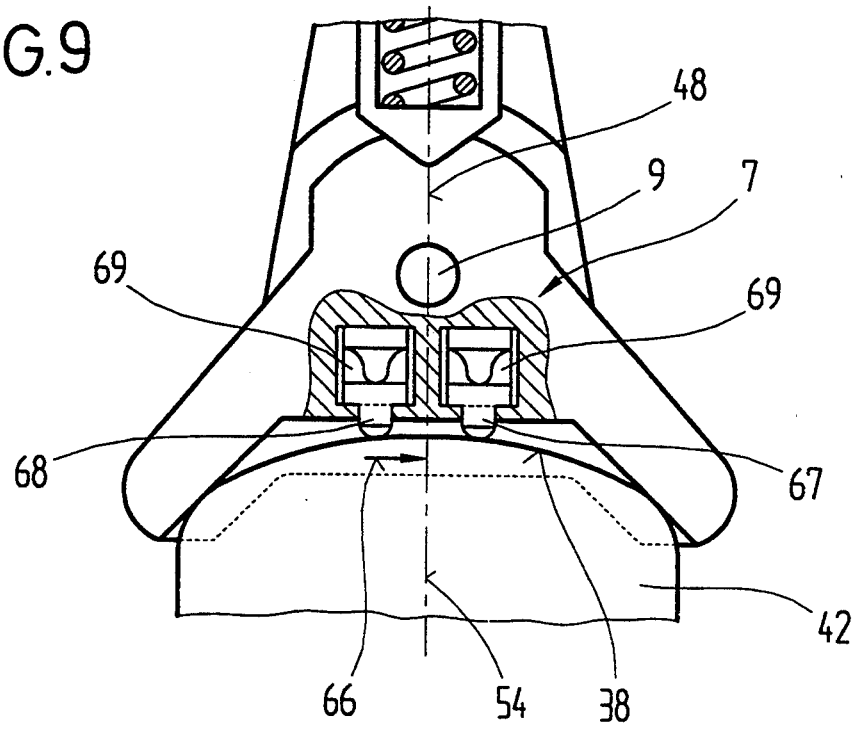
FIG. 9 is an alternate embodiment of the front clamp.

In FIG. 3 and FIG. 4, front clamp 3 of safety ski binding 2 has been formed with spring devices 37 indicated in the above instance with spring arms or bow springs (as shown in FIG. 9). In addition to spring devices 37 formed as spring flaps there can be applied the additional spring device 40 or 41, on the other side of each spring device 37 at front side 38 of sole 39. In this manner there can be modification at will of the tension exercised by spring devices 37 in the direction of heel clamp 5. In addition, as schematically shown by differing darknesses of the crosshatching of spring devices 40 and 41, it is possible, for example, to supply spring device 41 with a firmer spring characteristic, thus a higher tension strength or a higher deformation resistance. Thus, disengagement movements which occur in the direction of outer edge 43, primarily occurring with the skis on edge in quick curve turns, are more strongly damped, or a higher restoring force is exercised on ski boot 42 as in a swing of front clamp 3 or fork prong 13 in the direction of inner edge 44 of ski 1 when the other ski is directly beside it.

By means of the tension on the ski boot between front clamp 3 and heel clamp 5, a force equilibrium is created between spring device 23 in the heel clamp and spring device 37 or spring devices 40 and 41, which serve as centering devices, which is manifested by deformation of spring device 37 out of the position shown by the interrupted lines into the position shown by the full lines and as the bulging of spring devices 40 and 41. For the sake of clarity, it is merely mentioned here that, for a better understanding of the function of safety ski binding 2 or the pictorial representation, the proportions of individual parts or their movement paths have been heavily exaggerated or distorted in scale in the representation.

Thus it is further evident that radius 45 in which spring devices 37 are arranged in circumstances of no tension is greater than distance 46 between front side 38 of spring device 37 extending to sole 39 in the relaxed state and a mid point of swing axis 9 of front clamp 3. By deformation due to the tension strength of spring device 23, the position of spring device 37 is altered and thereby radius 47 is also increased, so that the displacement in the direction of central longitudinal axis 48 between forward side 38 of sole 39 and spring devices 37 during their opposing rotation is slight in a relative displacement between sole 39 and front clamp 3.

As can be better seen in FIG. 4, spring devices 37 extend their entire lengths from front clamp 3. It is desirable to attain a greater tension effect of spring devices 37, so the free, jutting lengths of spring devices 37 can also be advantageously shortened. Naturally, spring devices 40 and 41 exercise the same spring characteristic and therefore the same spring orientation with the same damping strength.

By the deformation of spring device 37 relaxed out of the interrupted lines in tension 37 the position of the full lines, distance 49 between two contact points 50 between the forward side 38 of sole 39 and spring devices 37 is enlarged to distance 51. By the relatively slight spring characteristic of spring device 37 in relation to release spring 52 by which each release strength and release orientation is determined, by which front clamp 3 freely snaps away to the side so that ski boot 42 can slide out of the ski binding.

Now, in the event of the slightest disengagement motion in the direction of double arrow 53, spring devices 37 react immediately to apply a counter force in the direction of restoration to center ski boot 42 between fork prongs 13. The pressure exercised on fork prong 13 is higher and cannot be blocked by the varied deformation of spring devices 37 so that forked clamp 7 again is steered out in the direction of double arrow 53, whereby, by an equivalent swivel movement, as shown in FIG. 2, ski boot 42 now only rests on fork prong 13 in the forward motion direction and on spring device 37 distanced therefrom.

Figure 5:
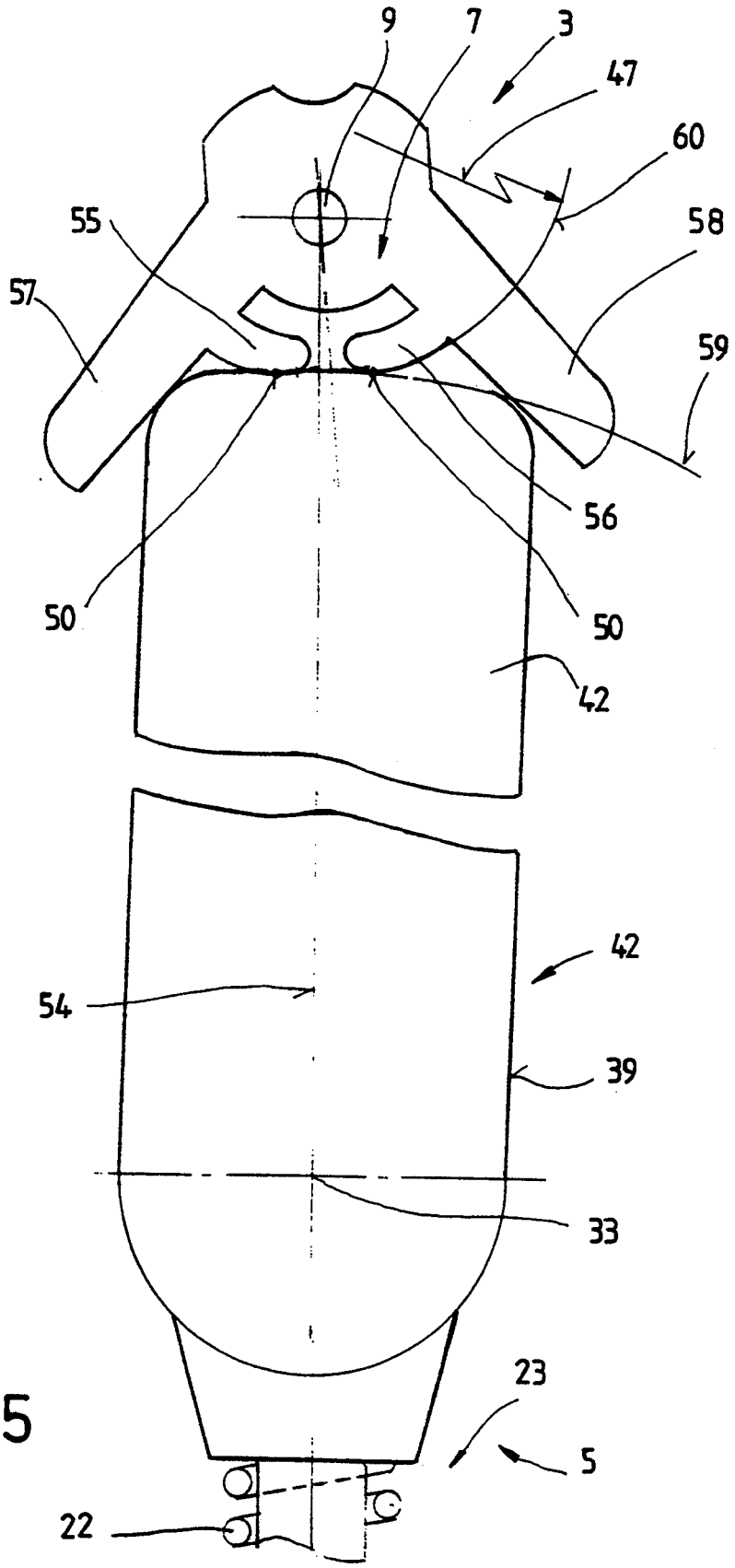
FIG. 5 is a representation of a ski binding in accordance with the invention in a highly simplified schematic, with a slight disengagement of the front clamp sideways.
Figure 6:
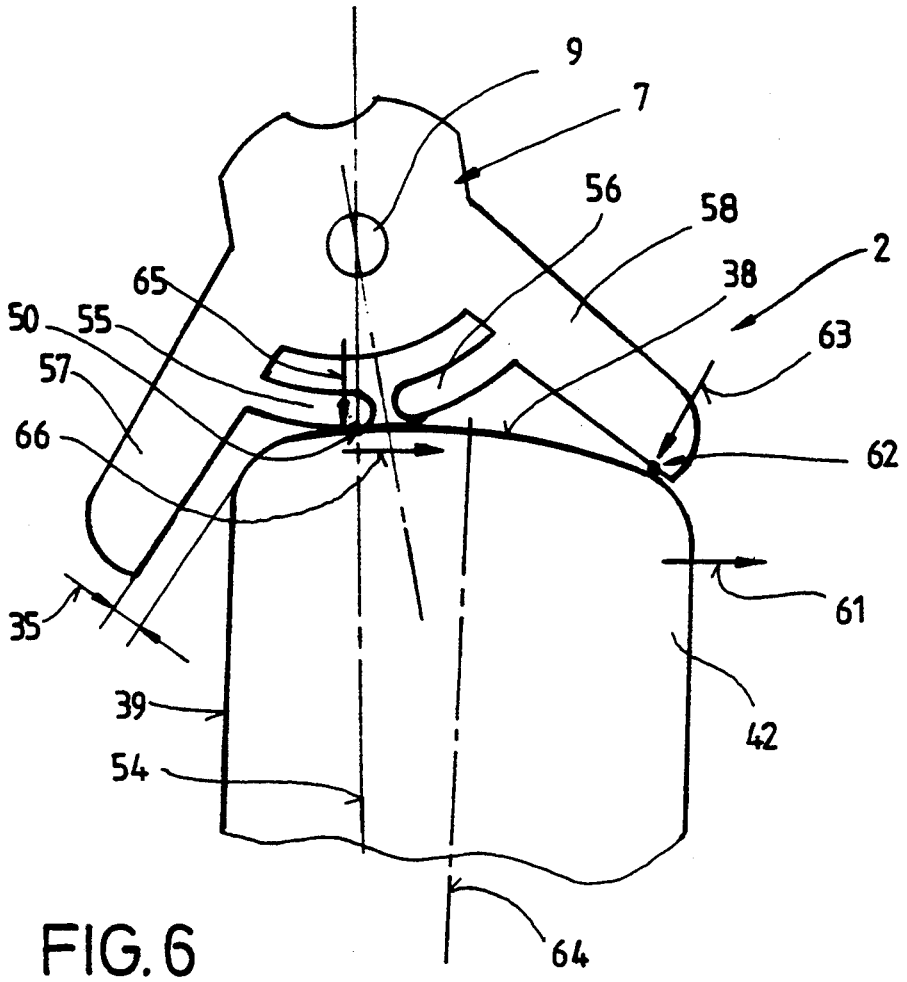
FIG. 6 is a representation of a ski binding in accordance with the invention in a highly simplified schematic, with severe disengagement of the front clamp sideways.

In FIG. 5 and FIG. 6 at this point are representations of forked clamp 7 of front clamp, 3 in slight disengagement from the main or rest position and in a significant disengagement of forked clamp 7 just ahead of the release of the freeing mechanism and the discharge of ski boot 42 from safety ski binding 2. By means of spring device 23 in heel clamp 5, sole 39 of ski boot 42 is pressed against spring devices 55 and 56 which are located between fork prongs 57 and 58. In a slight disengagement of ski boot 42 from rest position 54, the ski boot swivels around the theoretical swing axis located in the area of the shin of the lower leg. Concurrently, there is a radius of roll off circle 59 lengthwise which moves frontal side 38 of ski boot 42 dependent on boot size. As a result of the deformation of spring devices 55 and 56, the sides against frontal side 38 of ski boot 42 are located inside an enclosure circle 60 with radius 47. What occurs now is a sideways disengagement of forked clamp 7 so that contact point 50 of spring device 55 lengthens in the direction of rest position 54 during which contact point 50 at spring device 56 is distanced therefrom. This has the effect that, when in practice, spring device 55 is also now slightly deformed in the direction of swing axis 9, while spring device 56 can be slightly relaxed. What occurs now is a differential force at both contact points 50 which causes an equilibrium to develop again between both tension strengths extending to contact points 50 which are raised by spring device 23.

It can furthermore be seen from FIG. 6 that, with the increase in release strength 61, sole 39 of ski boot 42 again swings in the direction of the arrow representing release strength 61 around swing axis 33 so that ski boot 42 is now directly supported at fork prong 58 now at contact point 62 which opposes the outward spring motion in the direction of release strength 61 with opposing force 63, which is raised by release spring 52. Ski boot 42 in this phase rocks forward over release springs of forked clamp 7 and fork prong 58 so that it is supported in the area of the heel clamp 5. By the off center influence of opposing force 63 against rest position 54 or boot axis 64, boot axis 64 of ski boot 42 now has a tendency to deviate in the direction of rest position 54, as, due to the relative movements through the rotation of roll off circle 59 on enclosure circle 60 between frontal side 38 around fork prong 57, gap 35 is present. In order to now prevent the ski boot from moving toward axis 9, holding force 66 is created by spring strength 65 applied with spring device 55. This prevents sideways deviation of ski boot 42 against this holding force 66 and thereby at the same time deviation in the direction of swing axis 9.

The advantage of this concept or arrangement is that when release force 61 is not sufficient to free or open the release mechanism, ski boot 42 can again swing back to its exact original rest position 54. The deformation force of spring devices 55 and 56 must be overcome so that, as in FIG. 3 for example, it can resume the position shown in the full lines. By support at contact point 62 at fork prong 58 right after the respective deformation and creation of opposing force in spring devices 55 and 56, again there is a split of the pressure force only contributed by spring device 23. To a great extent, spring devices 55 and 56 as described above, have the tendency to direct or center ski boot 42 and forked clamp 9 toward each other.

Figure 7:
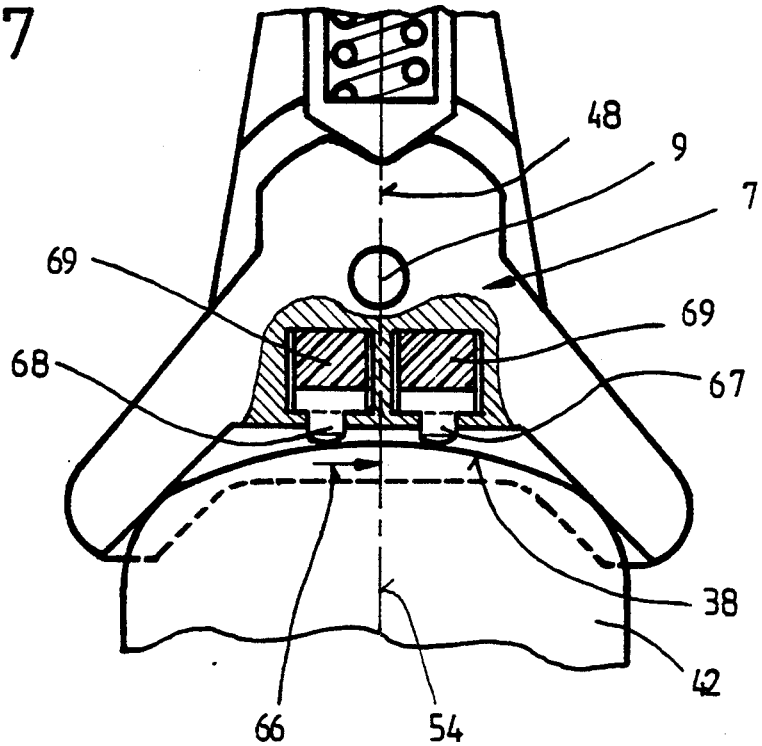
FIG. 7 is another production variant of a front clamp with centering devices formed in accordance with the invention, in overview.

In FIG. 7 another production form of front clamp 3 is shown. This front clamp 3 is equipped with centering devices 67 and 68 which are arranged in forked clamp 7 in the rest position 54. The two centering devices 67 and 68 are comprised of encased bulbs formed as lozenges or balls at the frontal side 38 of ski boot 42. Centering devices 67 and 68 are supported by spring device 69 in front clamp 3 so that relative positioning in the lengthwise direction of rest position 54 or the central longitudinal axis 48 is possible. By selection of the characteristic of spring device 69, which, for example, can have various spring characteristics as already described in connection with FIG. 3, the result is the creation of force opposing that of the counter force from spring device 23, or holding force 66, as was described by way of example in the previous FIG. 3 to FIG. 6.

Figure 8:
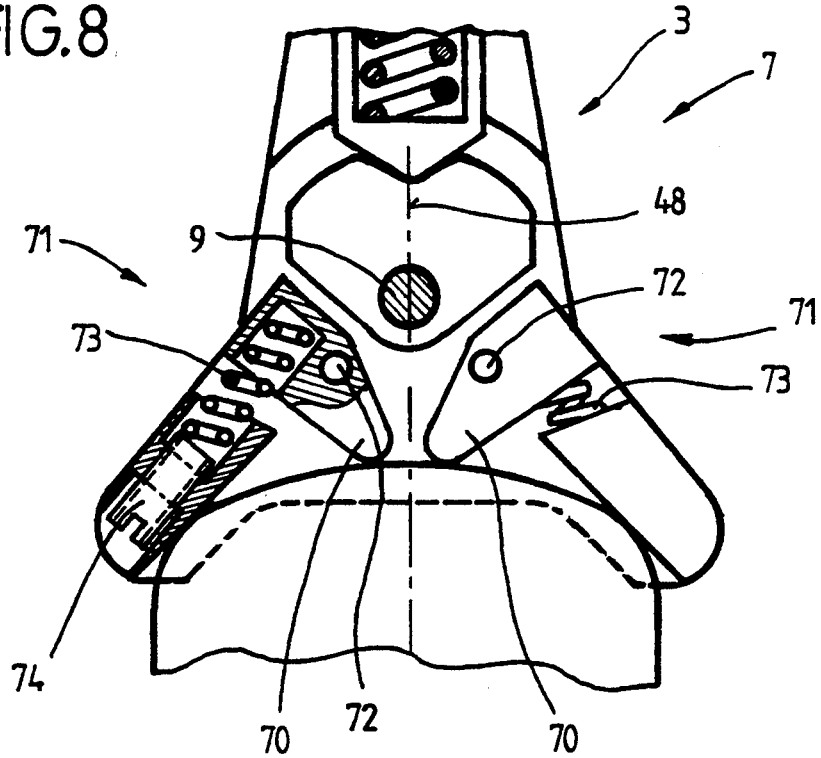
FIG. 8 is another model of a front clamp with centering devices formed of swing arms, in overview.

In the production form shown in FIG. 8, swing arms 70 are equipped with centering devices 71. Swing arms 70 can be moved on swing axis 72 swinging against the effect of spring elements 73 in the lengthwise direction of central longitudinal axis 48. The spring characteristic of spring devices 73 can result, for example, from moving screw rod 74 which serves as abutment for spring devices 73.

The manner of operation and function of these centering devices 71 correspond to those represented above in detail in FIG. 1 to FIG. 6. Naturally, spring devices 37 or centering devices 67 and 68 or 71 can take other appropriate forms, for example that of angled arms, rollers or other cross-section.

Front clamps 3 or heel clamps 5 in FIG. 3 to FIG. 8 were significantly simplified and partially schematic, as well as partially distorted in scale, in representation, in order to be able to better represent the function of the spring or centering devices in the invention. In these figures it was primarily the view from below that was chosen so that various parts of forked clamp 7 which extend over frontal side 38 of ski boot 42 do not cover the significant area for the joint working of the spring or centering devices and frontal side 38.

Furthermore, the lay out of front clamp 3 is in no sense restricted to the production example shown in the drawings but, rather, front clamps can also be used which, approaching release, can be released in a vertical axis 9 and vertical thereto and parallel to assembly plane 75 as shown in FIG. 4. Spring devices 37 described in FIG. 1 to FIG. 4 formed as spring flaps also work as centering devices so that the function of centering and spring device are unified if the spring action of the material properties or formation of the centering devices is achieved as in the case represented by FIG. 1 to FIG. 4.

Naturally, it is also possible to apply spring devices with inserted metal cores of spring steel instead of a single piece as the spring flap formed on front clamp 3 of plastic. As further shown in FIG. 3, there is a distance 49 running parallel to assembly plane 75 between two contact points 50 which is less than half of width 76. It is recommended that this distance amount to between 5 mm and 25 mm, preferably 10 mm.

Furthermore, it must also be mentioned that spring devices 37 or spring flaps 36 are coated with a friction reducing material such as TEFLON, at least in each area where the ski boot comes into contact. This primarily concerns contact points 50 and 62. Thus it is also possible to encase the jutting ends of the spring flaps in slide covers.

I claim:

1. A ski binding for a longitudinally extending ski having a central longitudinal axis comprising:

a forked heel clamp for holding a rear part of a ski boot;

a forked toe clamp including two fork prongs, facing said heel clamp, for holding a front part of a ski boot, said toe clamp being rotatable around an axis located on a side of said prongs away from said heel clamp; and centering means formed as two arcuate spring devices located on said toe clamp on opposite sides of the central longitudinal axis of the ski and having a front side facing said heel clamp including ski boot contact points, said arcuate spring devices being made from a stiff, elastic, synthetic material and being formed as an integral unit with said toe clamp, said arcuate spring devices being flexible in the longitudinal direction and having radii centered on the longitudinal ski axis, said radii of said unflexed arcuate spring devices being larger than a distance between the toe clamp axis and said front side of said centering means; and a distance between said contact points being less than one half of a width of said toe clamp.

2. The ski binding according to claim 1, wherein said spring devices are formed by spring flaps having free ends lying close to the front part of the ski boot.

3. The ski binding according to claim 2, wherein said spring flaps extend from said fork prongs in a direction generally transverse to the central longitudinal axis of the ski, so that said spring flaps face each other.

4. The ski binding according to claim 3, additionally including a tension screw spring and a slot, said forked heel clamp is guided in the longitudinal direction by the slot and is biased towards said toe clamp by said tension screw spring, and the front part of the ski boot directly contacts said spring devices located between said fork prongs.

5. The ski binding according to claim 4, wherein the force of said spring device is approximately equal to the force of said tension screw spring.

6. The ski binding according to claim 4, wherein the force of said spring devices is less than the force of said tension screw spring.

7. The ski binding according to claim 6, wherein said centering means are supported by interchangeable rubber inserts and synthetic inserts.

a forked toe clamp including two fork prongs, facing said heel clamp, for holding a front part of a ski boot, said toe clamp being rotatable around an axis located on a side of said prongs away from said heel clamp; and centering means formed as two arcuate spring devices located on said toe clamp on opposite sides of the central longitudinal axis of the ski and having a front side facing said heel clamp including ski boot contact points, said arcuate spring devices being made from a stiff, elastic, synthetic material and being formed as an integral unit with said toe clamp, said arcuate spring devices being flexible in the longitudinal direction and having radii centered on the longitudinal ski axis, said radii of said unflexed arcuate spring devices being larger than a distance between the toe clamp axis and said front said of said centering means; and a distance between said contact points being less than one half of a width of said toe clamp.

8. The ski binding according to claim 1, wherein the distance running parallel to a top surface of the ski between said contact points is generally in a range of 5 mm to 20 mm.

9. The ski binding according to claim 8, wherein the distance between contact points of said centering means is 10 mm.

10. The ski binding according to claim 9, wherein said toe clamp axis passes through a plane oriented perpendicular to a top surface of the ski and passing through the central longitudinal axis and a front side of said heel clamp facing said toe clamp, wherein rotation of said toe clamp brings one of said contact points into intersection with the plane.

* * * * *